US007552925B2

(12) United States Patent
Kozaki et al.

(10) Patent No.: US 7,552,925 B2
(45) Date of Patent: Jun. 30, 2009

(54) IMAGE RECORDING APPARATUS

(75) Inventors: Daisuke Kozaki, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 122 days.

(21) Appl. No.: 11/677,169

(22) Filed: Feb. 21, 2007

(65) Prior Publication Data

US 2007/0194515 A1 Aug. 23, 2007

(30) Foreign Application Priority Data

Feb. 22, 2006 (JP) ..... 2006-044873

(51) Int. Cl.
*B65H 5/00* (2006.01)

(52) U.S. Cl. ..... 271/264; 399/393

(58) Field of Classification Search ..... 271/145, 271/114, 117, 163, 164; 399/393; 347/104
See application file for complete search history.

(56) References Cited

U.S. PATENT DOCUMENTS 4,037,953 A * 7/1977 Sone et al. ..... 355/45
5,527,026 A * 6/1996 Padget et al. ..... 271/21
6,227,535 B1 * 5/2001 Bae ..... 271/121
6,382,620 B1 * 5/2002 Gaarder et al. ..... 271/117
6,692,122 B2 * 2/2004 Park ..... 347/104
2005/0194732 A1 9/2005 Asada
2005/0242485 A1 11/2005 Shiohara et al.

FOREIGN PATENT DOCUMENTS

JP H09-002673 A 1/1997
JP 2005-247521 A 9/2005
JP 2005-314067 A 11/2005

* cited by examiner

*Primary Examiner*—Patrick H Mackey
*Assistant Examiner*—Ernesto Suarez
(74) *Attorney, Agent, or Firm*—Baker Botts LLP

(57) ABSTRACT

An image recording apparatus includes; a recording unit which records on sheet-like recorded media; a cassette housing provided at a lower end of an apparatus casing and which houses a paper feeding cassette which accommodates the recorded media; a bottom plate provided on the lower surface of the cassette housing and which supports at least a part of a lower surface of the paper feeding cassette; an arm body which turns upward and downward according to a stacking amount of the recorded media in the paper feeding cassette; feed rollers arranged at an tip end of the arm body and which rotate while pressing the uppermost surface of the recorded media; and a restricting unit provided on the bottom plate in the apparatus casing and which avoids contact of the feed rollers with the bottom plate when the paper feeding cassette is pulled out of the apparatus casing.

6 Claims, 15 Drawing Sheets

IMAGE RECORDING APPARATUS

CROSS-REFERENCE TO THE RELATED APPLICATION(S)

This application is based upon and claims priority from prior Japanese Patent Application No. 2006-044873 filed on Feb. 22, 2006, the entire content of which is incorporated herein by reference.

TECHNICAL FIELD

The present invention relates to a configuration of an image recording apparatus having a paper feeding unit which feeds paper (hereinafter, referred to as recorded media) such as cut sheets of paper or synthetic resin-made sheets, one by one to an image recording unit.

BACKGROUND

Conventionally, for feeding recorded media in a form opposing a recording unit of an ink-jet type image recording apparatus or the like, there is known a paper feeding unit including a feed roller at a tip end of an arm body whose base end is pivotally supported on an apparatus casing in a manner enabling it to turn upward and downward. According to this paper feeding unit, due to an urging force of a spring that presses the arm body, the feed roller is pressed against the uppermost surface of paper stacked and accommodated in a paper feeding unit of a paper feeding cassette or the like whose upper face is open. By rotating the feed roller in this state, the ends of paper are butted against an inclined separating wall formed on an end on the downstream side of a feed direction of the paper feeding unit and only the uppermost paper is separated and fed toward the image recording unit (refer to JP-A-2005-247521).

On the other hand, as shown in the image recording apparatus described in JP-A-09-2673, a bottom plate is provided on the lower end of the apparatus casing, and a space above the bottom plate is formed into a cassette housing. Usually, the paper feeding cassette can be inserted into and extracted from this cassette housing substantially in the horizontal direction. In this configuration, due to use for a long period of time, dust and paper powder accumulate on the bottom plate.

However, in the case of the configuration in which the arm body is urged downward as in the case of JP-A-2005-247521 being applied to the configuration of JP-A-09-2673, when the paper feeding cassette is pulled out of the apparatus casing and the lower surface of the feed roller at the lower end of the arm body comes into contact with the bottom plate, dust and paper powder adhere to the lower surface of the feed roller. Thereafter, when the paper feeding cassette is inserted into the cassette housing again, the feed roller comes into contact with the uppermost surface of the recorded media stacked in the paper feeding cassette. If the feed roller rotates in this state, dust and paper powder adhere to and contaminate the surface of the recorded media, and if the recorded media are conveyed to the recording unit, the conveying path is contaminated and the quality of image recording on the recorded media is significantly deteriorated.

SUMMARY

As means for solving the above-described problem, for example, the configuration shown in FIG. 15 was considered. That is, the space between the bottom plate 106 of the apparatus casing and the bottom flat plate 100*a* of the engine frame

100 fixed above the bottom plate is formed into a cassette housing (space) 105 which a paper feeding cassette (not shown) can be inserted into and extracted from substantially in the horizontal direction. A drive shaft 102 is pivotally supported on a side above the bottom plate 100*a* of the engine frame 100 on which a recording unit is mounted, and a base end of an arm body 101 is pivotally supported on this drive shaft 102 in a manner enabling it to turn upward and downward. The feed roller 103 attached to the tip end of the arm body 101 is made to face the cassette housing (space) 105. The arm body 101 is urged downward by an urging spring that is not shown. The base end side of the arm body 101 is arranged within an arrangement hole (not shown) made in the bottom plate 100*a* of the engine frame 100. On one side of the arm body 101, a stopper piece 104 which collides with the lower surface of the bottom flat plate 100*a* to block the lowering of the arm body 101 when the tip end side of the arm body 101 turns downward to a predetermined turning restriction angle θ1 is projectedly formed sideways.

With the above configuration, when the paper feeding cassette is extracted from the cassette housing (space) 105, downward turning of the arm body 101 is restricted by the stopper piece 104 and contact of the feed roller 103 at the lower end of the arm body 101 with the surface of the bottom plate 106 of the apparatus casing can be prevented.

However, due to an attaching tolerance of the drive shaft 102 of the arm body 101 to the engine frame 100 and a manufacturing tolerance in the height direction of the bottom flat plate 100*a* of the engine frame 100, the turning restriction angle θ1 easily scatters. In addition, the distance from the contact point between the stopper piece 104 and the lower surface of the bottom flat plate 100*a* to the turning axis line (drive shaft 102) of the arm body 101 is very short and the distance from the turning axis line of the arm body 101 to the feed roller 103 is long, so that only a slight increase in θ1 from a set value causes the feed roller 103 at the tip end of the arm body 101 to come into contact with the surface of the bottom plate 106 of the apparatus casing. Therefore, to prevent this, the bottom plate 106 of the apparatus casing and the bottom flat plate 100*a* of the engine frame 100 must be set so that a sufficient height is secured between the surface of the bottom plate 106 and the bottom flat plate 100*a*, and this inevitably increases the height and size of the entire image recording apparatus.

Aspects of the invention provide an image recording apparatus which does not need to be increased in height and includes a feed unit that prevents dust and paper powder from adhering to the feed rollers even when the paper feeding cassette is removed.

According to an aspect of the invention, there is provided an image recording apparatus including: a recording unit which records on sheet-like recorded media; a cassette housing which houses a paper feeding cassette which accommodates the recorded media in a stacked manner so that the cassette can be inserted into and extracted from the cassette housing substantially in a horizontal direction, the cassette housing provided at a lower end of an apparatus casing; a bottom plate which supports at least a part of a lower surface of the cassette, the bottom plate provided on a lower surface of the cassette housing; an arm body which turns upward and downward according to a stacking amount of the recorded media in the cassette, the arm body arranged inside the apparatus casing; feed rollers which rotate while pressing an uppermost surface of the recorded media, the feed rollers arranged at a tip end of the arm body; and a restricting unit which avoids contact of the feed rollers with the bottom plate when the cassette is pulled out of the apparatus casing, the restricting unit provided on the bottom plate in the apparatus casing.

DETAILED DESCRIPTION

Aspects of the present invention will be described in detail with reference to the accompanying drawings.

Figure 1:
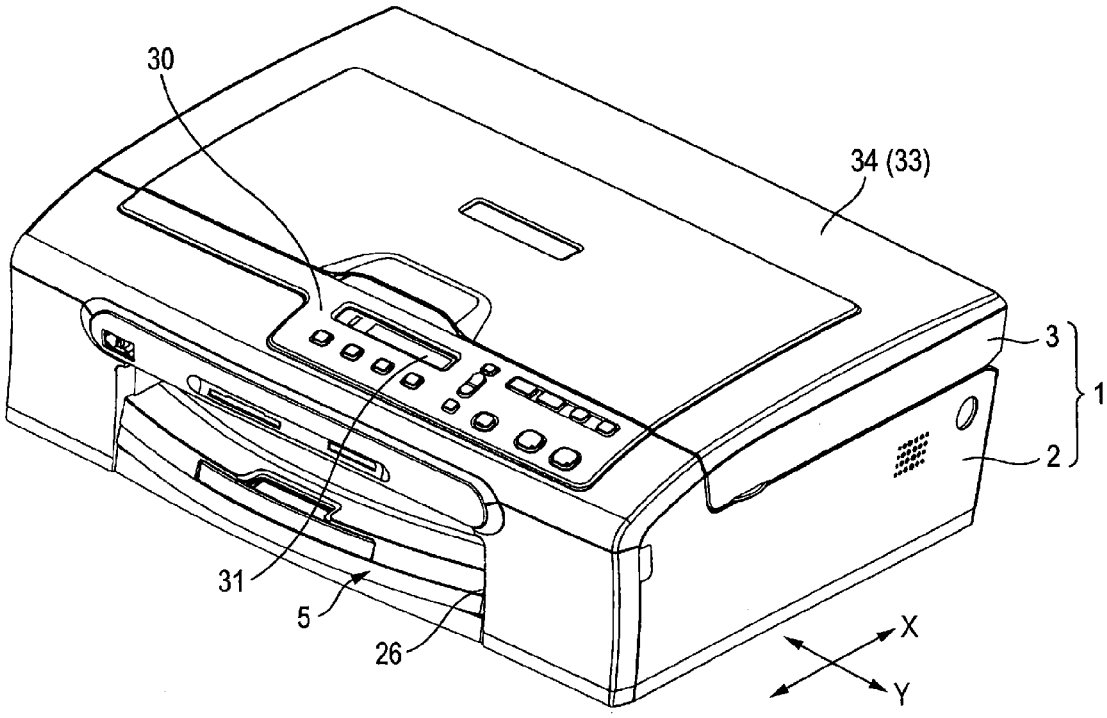
FIG. 1 is an entire perspective view of an image recording apparatus.

The multi-function type image recording apparatus 1 shown in FIG. 1 has a facsimile function, a printer function, a copying function, a scanner function, etc. The image recording apparatus 1 as a multi-function device includes an apparatus casing 2 that is a main body case substantially in a shape of a box whose upper face is open, and an upper case 3 which is pivotally attached to one side (rear right side in the aspect of FIG. 1) of this apparatus casing 2 via a turning axis line portion (not shown) such as a hinge in a manner enabling the upper case to turn upward and downward. In the description given below, the front side of the image recording apparatus 1 of FIG. 1 is defined as a front side, and the left and right direction (main scanning direction, Y axis direction), the front and rear direction (vertical scanning direction, X axis direction), and the up and down direction are also defined based on the orientation of the image recording apparatus 1 of FIG. 1. The apparatus casing 2 and the upper case 3 are injection-molded items made of a synthetic resin.

An operation panel 30 is arranged on the upper surface front side of the upper case 3. On the operation panel 30, various buttons such as numeric buttons, a start button, and function operating buttons are provided, and by depressing these buttons, various operations are performed. On the operation panel 30, a display unit 31 such as a liquid crystal display (LCD) is provided, and a setting status and various operation messages of the image recording apparatus 1 are indicated on the operation panel 30 as appropriate.

A scanner (image reading unit) 33 is arranged on the rear side of the operation panel 30 in the upper case 3. That is, the scanner 33 for reading a facsimile document to be transmitted to a destination facsimile when performing the facsimile function and an image on a document to be copied when performing the copying function includes a flat bed reading unit which reads an image on a document on a large-sized glass plate and a turnable cover 34 which covers the upper surface of this flat bed reading unit.

Immediately under the glass plate of the flat bed reading unit, a line type contact image sensor (CIS), as an example of a photoelectric converter for reading an image surface of a document in contact with the glass plate, is provided so as to reciprocate along a guide shaft extending parallel to a movement direction (main scanning direction, Y axis direction) of a carriage that will be described later (although this sensor is not shown). The cover 34 is constructed so as to turn to open and close via a hinge around the back surface side (rear side of FIG. 1) of the image recording apparatus 1.

Next, a configuration of the apparatus casing 2 and a printer (recording unit) will be described. As shown in FIG. 1, at a lower end of the left and right central portion inside the apparatus casing 2, a paper feeding cassette 5 as a paper feeding unit in which a plurality of sheets of paper P as recorded media are placed substantially horizontally in a stacked manner is arranged, and this paper feeding cassette 5 is constructed so as to be inserted into and extracted from an opening (insertion port) 2*a* in the front surface of the apparatus casing 2 substantially in the horizontal direction.

Furthermore, inside the apparatus casing 2, a feed roller unit 6 as a paper feeding unit including feed rollers 7, a conveying path for conveying sheet P forward substantially horizontally through an upward U-turn conveying path 9 on the rear end inside the apparatus casing 2, and a recording unit unit 10 including an ink-jet recording head 12 which records images by jetting ink to the surface of the sheet P on a platen 11 as a tabular paper supporting unit arranged in this conveying path, are arranged above the paper feeding cassette 5.

Ink cartridges 26 for supplying ink to a color recording head 12 are arranged inside the apparatus casing 2 so as to be attachable and detachable from above to and from a housing 27 (see FIG. 2) at a position that faces a side surface plate including the turning axis line portion and close to an inner surface of the side surface plate at a most spaced position. The ink cartridges 26 contain inks of a plurality of colors, and the inks may be the four colors of black, cyan, magenta, and yellow in this aspect, however, more inks may be contained. The inks are supplied by connecting a flexible ink tube 28 from the respective ink cartridges 26 to the recording head 12.

Figure 2:
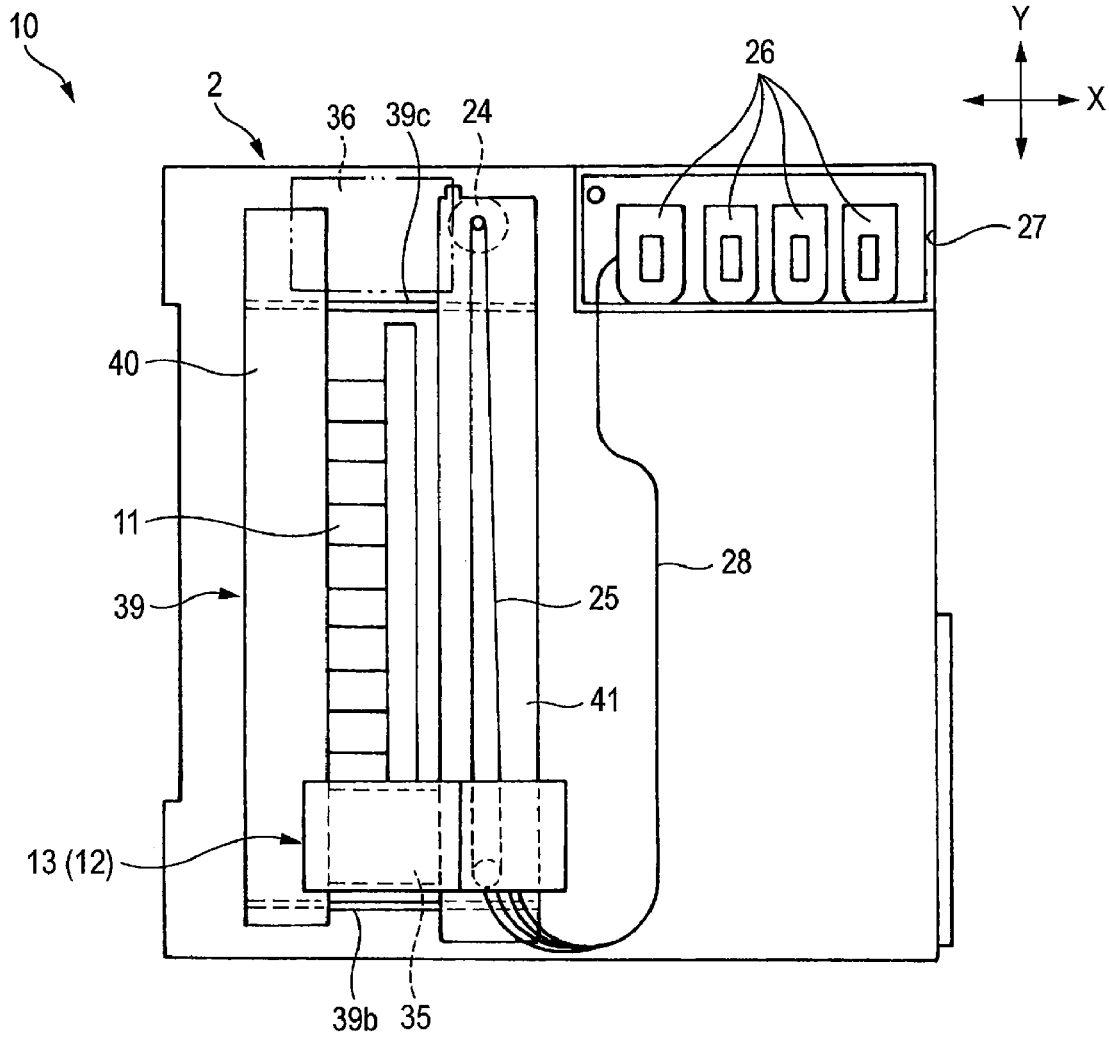
FIG. 2 is a plan view of an apparatus casing from which an upper case is removed.
Figure 3:
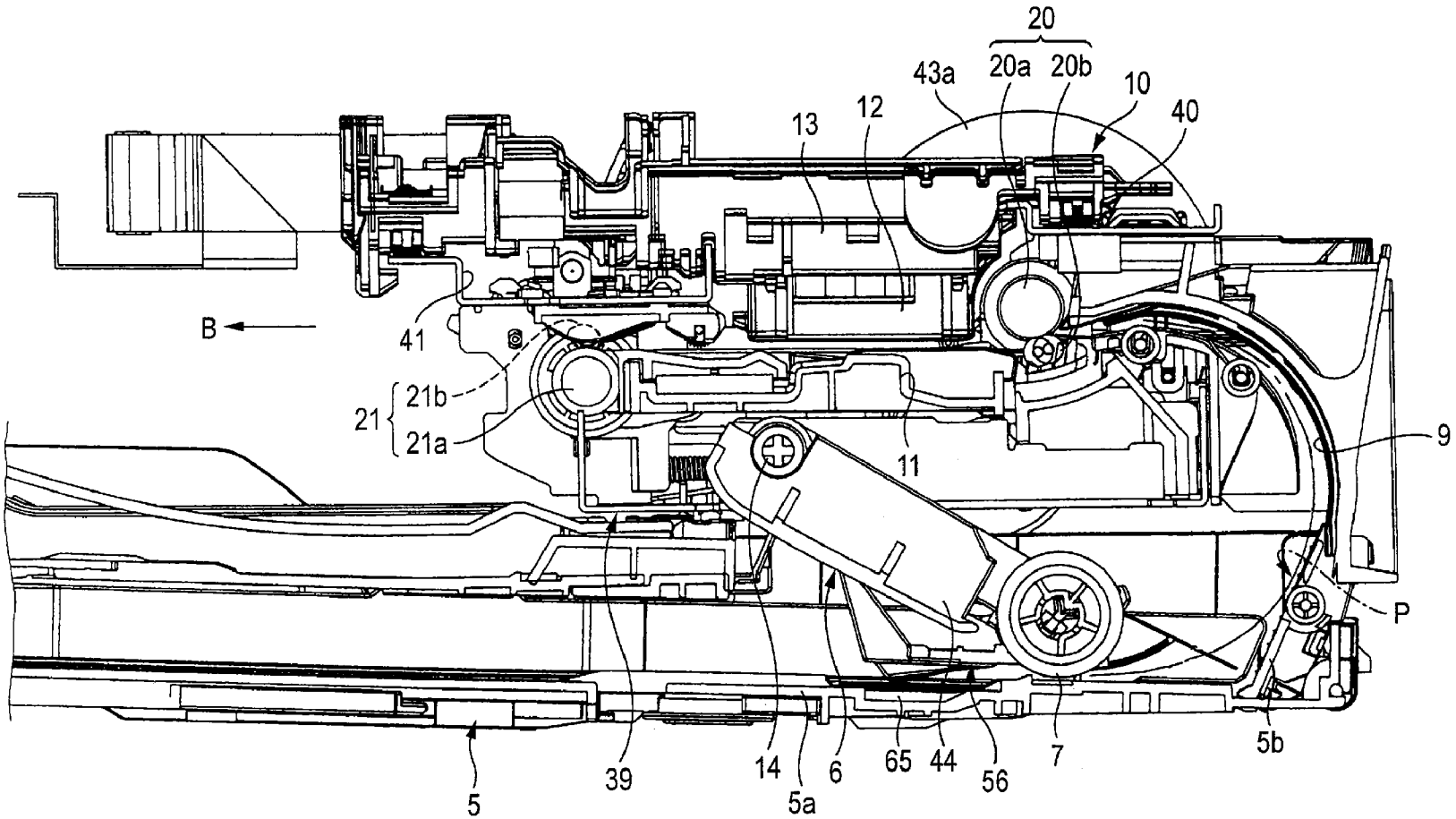
FIG. 3 is a side sectional view of a left and right central portion of a recording unit.
Figure 4:
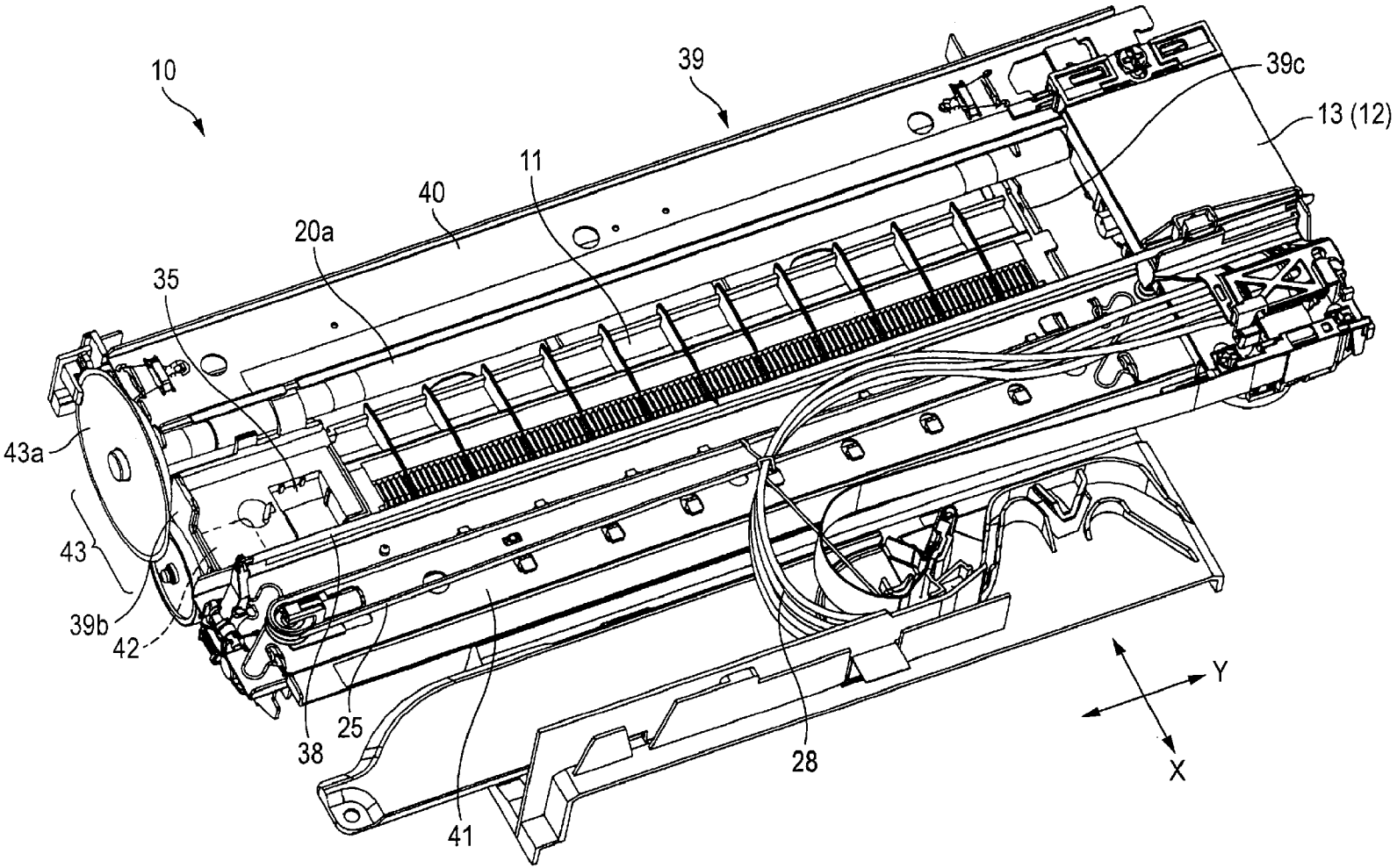
FIG. 4 is a perspective view of the recording unit.

As shown in FIG. 2 through FIG. 4, the recording unit unit 10 is mainly constituted of a carriage 13 including the recording head 12, a plate-shaped platen 11 made of a synthetic resin, a carriage (CR) motor 24 for reciprocating the carriage 13, a timing belt 25 connected to this CR motor 24, and an engine frame 39 formed of a metal plate for supporting these components. The engine frame 39 is arranged above the paper feeding cassette 5 on the rear side of the apparatus casing 2. The engine frame 39, as a supporting frame made of metal, is formed by attaching a pair of guide plates 40 and 41 that extend in the left and right direction (main scanning direction, Y axis direction) of the apparatus casing 2 on the upper side of the box-shaped main body as shown in FIG. 2 and FIG. 4, and supports the carriage 13 slidably. On the guide plate 41 on the downstream side of the conveying direction, a linear encoder (encoder strip) 38 is arranged so as to extend along the longitudinal direction (main scanning direction) of the guide plate and detects the position of the carriage 13 in the Y axis direction (main scanning direction). This strip-shaped linear encoder (encoder strip) is arranged so that its inspection surface (the surface in which slits are formed at constant intervals in the Y axis direction) is along the vertical direction.

An ink receiver 35 is arranged to be wider than the width of the sheet P to be conveyed (shorter side of the sheet P in FIG. 4), on one end side of the width (in this aspect, a portion of the main body of the engine frame 39 close to the side plate 39*b* on the left with respect to the feed direction of the sheet P). On the other end side (portion close to the side plate 39*c* on the right of FIG. 4), a maintenance unit 36 is arranged. Thereby, the recording head 12 periodically performs ink discharge for preventing clogging of a nozzle during a recording operation at a flushing position provided on the ink receiver 35, and receives ink by an ink receiving unit 35.

For the maintenance unit 36, a position at which the carriage 13 is in the main scanning direction (Y axis direction) and at the rightmost end position of FIG. 4 is defined as an origin position, and a position to which the carriage 13 is moved leftward along the Y axis direction from the origin position is defined as a maintenance position that is simultaneously used as a standby position. At the maintenance position to be simultaneously used as a standby position, a cap portion (not shown) of the maintenance unit 36 covers the nozzle surface of the recording head 12 from below. The LF motor 42 is driven and actuates a suction pump (not shown) to selectively suction ink from the nozzle or perform restoration processing for removing bubbles in a buffer tank that is not shown on the recording head 12. When the carriage 13 moves laterally from the maintenance unit 36 to an image recording area, the nozzle surface is wiped and cleaned with a cleaner (wiper blade) that is not shown.

Both ends of the conveying roller 20*a* to be driven of the resist roller (conveying roller) pair 20 which are arranged on the upstream side in the conveying direction across the platen 11 for feeding the sheet P to the lower surface 12 of the recording head 12, and both ends of the eject roller 21*a* to be driven of the eject roller pair 21 which are arranged on the more downstream side of the conveying direction than the platen 11 and are for conveying recorded sheet P to an eject unit (see direction of the arrow B of FIG. 3), are pivotally supported on shaft support portions provided on a pair of side plates 39*b* and 39*c* of the engine frame 36 in a manner enabling these to rotate. The sheet P to be conveyed is nipped between the conveying roller 20*a* to be driven on a position above the paper and the driven conveying roller 20*b* on a position below the paper. The eject roller 21*a* to be driven of the eject roller pair 21 comes into contact with the lower surface of the sheet P to be ejected, and the spur roller 21*b* nips the upper surface of the sheet P by coming into contact with the upper surface of the sheet P.

Figure 5:
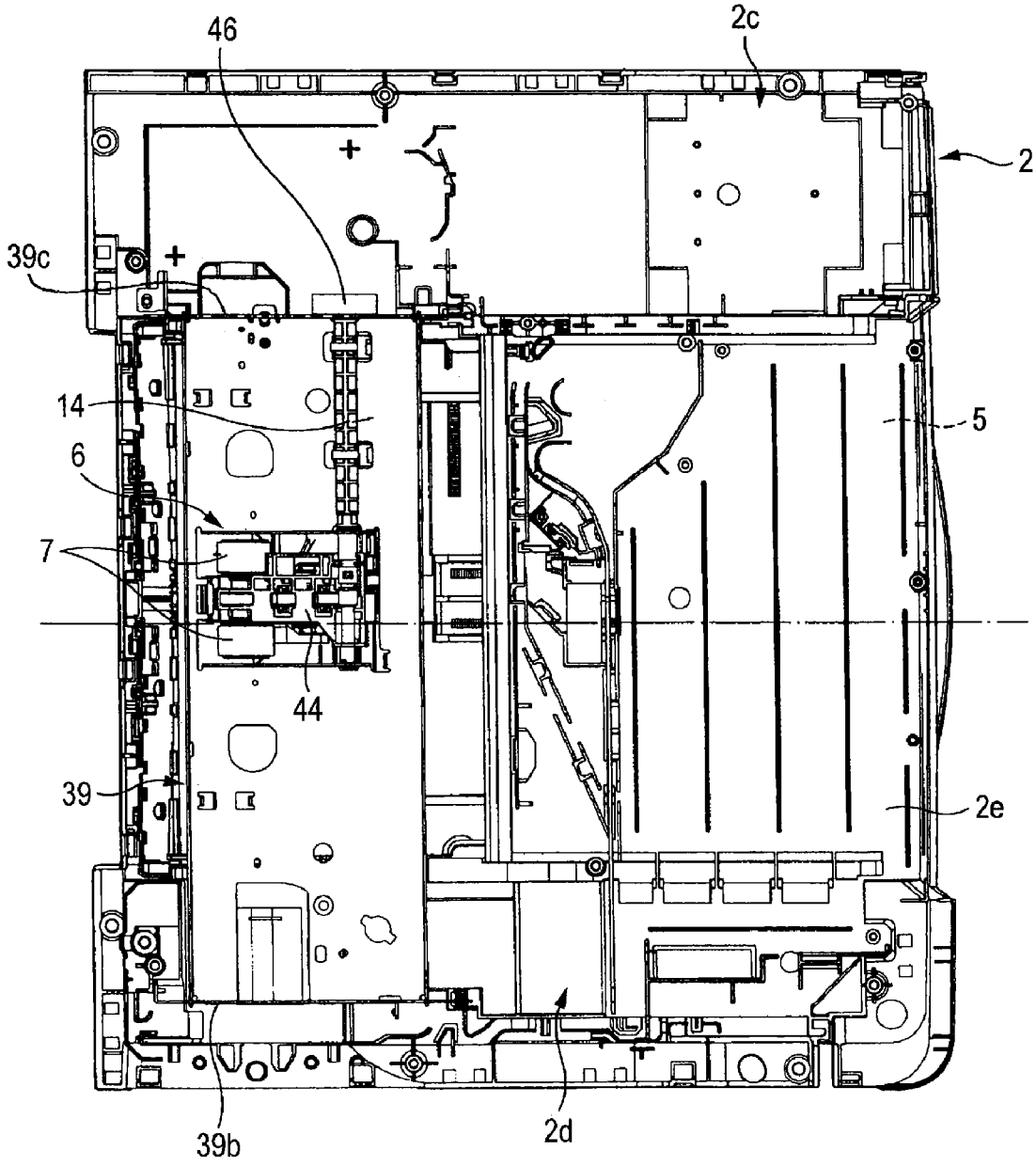
FIG. 5 is a plan view of an engine frame and the apparatus casing.

Then, to the conveying roller 20*a*, the eject roller 21*a*, and the maintenance unit 36, power from one LF motor (paper conveying motor) 42 (see FIG. 4) arranged near the side plate 39*b* opposite the side where the maintenance unit 36 is arranged, is transmitted via a predetermined gear transmission mechanism 43 (see FIG. 4). In this aspect, the torque from the LF motor 42 is transmitted to a gear 46 (see FIG. 5 and FIG. 7) of the drive shaft 14 in the feed roller unit 6 via a power transmission switching portion (not shown) to the maintenance unit 36 from the other end of the conveying roller 20*a*.

On apart of the gear transmission mechanism 43, a rotary encoder 43*a* for detecting a conveying amount of the sheet P conveyed by the conveying roller pair 20*a* is provided. The CR motor 24 and the LF motor 42 are both rotatable in forward and reverse.

Next, the configuration of the lower end of the apparatus casing 2 and the structure of housing of the paper feeding cassette 5 in the cassette housing 2*f* at this lower end will be described.

The right portion of the apparatus casing 2 is a partitioned section 2*c* in which the housing 27 for the ink cartridges 26 and so on are provided, and the left portion of the apparatus casing 2 is a partitioned section 2*d* in which a control board and a power transmission unit, etc. are housed, although these are not shown.

On the bottom side of the front side of the apparatus casing 2, a thin tabular first support 29*a* is integrally provided so as to link the left and right partitioned sections 2*d* and 2*c*, and at a position appropriately higher than the first support, the left and right partitioned sections 2*d* and 2*c* are linked by a top plate 2*e*, whereby a space enclosed by the left and right partitioned sections 2*d* and 2*c*, the first support 29*a*, and the top plate 2*e* is opened as the insertion port (opening) 2*a*. On the bottom of the inner side of the inserting direction of the paper feeding cassette 5 in the apparatus casing 2, a second support 29*b* as a thin tabular bottom flat plate is integrally provided so as to link the left and right partitioned sections 2*d* and 2*c* on the rear side of the apparatus casing 2 and the rear vertical plate 2*b*. Between the first support 29*a* and the second support 29*b*, an opening 29*c* perforating vertically is formed (see FIG. 6). Therefore, the cassette housing 2*f* is a space which is above the first support 29*a* and the second support 29*b* and is enclosed by the left and right partitioned sections 2*d* and 2*c*, the insertion port 2*a*, and the rear vertical plate 2*b*. In the opening 29*c*, a bottom surface (bottom 5*a*) of the paper feeding cassette 5 is exposed downward to a wide area when the paper feeding cassette 5 is housed in the cassette housing 2*f*.

When inserting, extracting and housing the paper feeding cassette 5, the bottom surface (bottom 5*a*) of the paper feeding cassette 5 is supported by the first support 29*a* and the second support 29*b* as bottom plates of the apparatus casing 2. Then, when housing the paper feeding cassette 5 in the cassette housing 2*f*, the bottom surface (bottom 5*a*) of the paper feeding cassette 5 is set so that a vertical gap is left between the bottom surface and the surface of the installed section at which a desktop plate (not shown) or the like faces the opening 29*c*. On the left and right side edges in the inserting direction of the paper feeding cassette 5 on the bottom of the apparatus casing 2 (between the left and right partitioned sections 2*d* and 2*c* and the opening 29*c* in the aspect), side guides 29*d* for guiding the side edges 5*c* provided on the left and right side edges in the inserting direction of the bottom surface (bottom 5*a*) of the paper feeding cassette 5 are formed so as to be continuous to and in contact with the second support 29*b* on a side outer from the opening and extending in a direction approaching the first support 29*a* (see FIG. 6).

Figure 6:
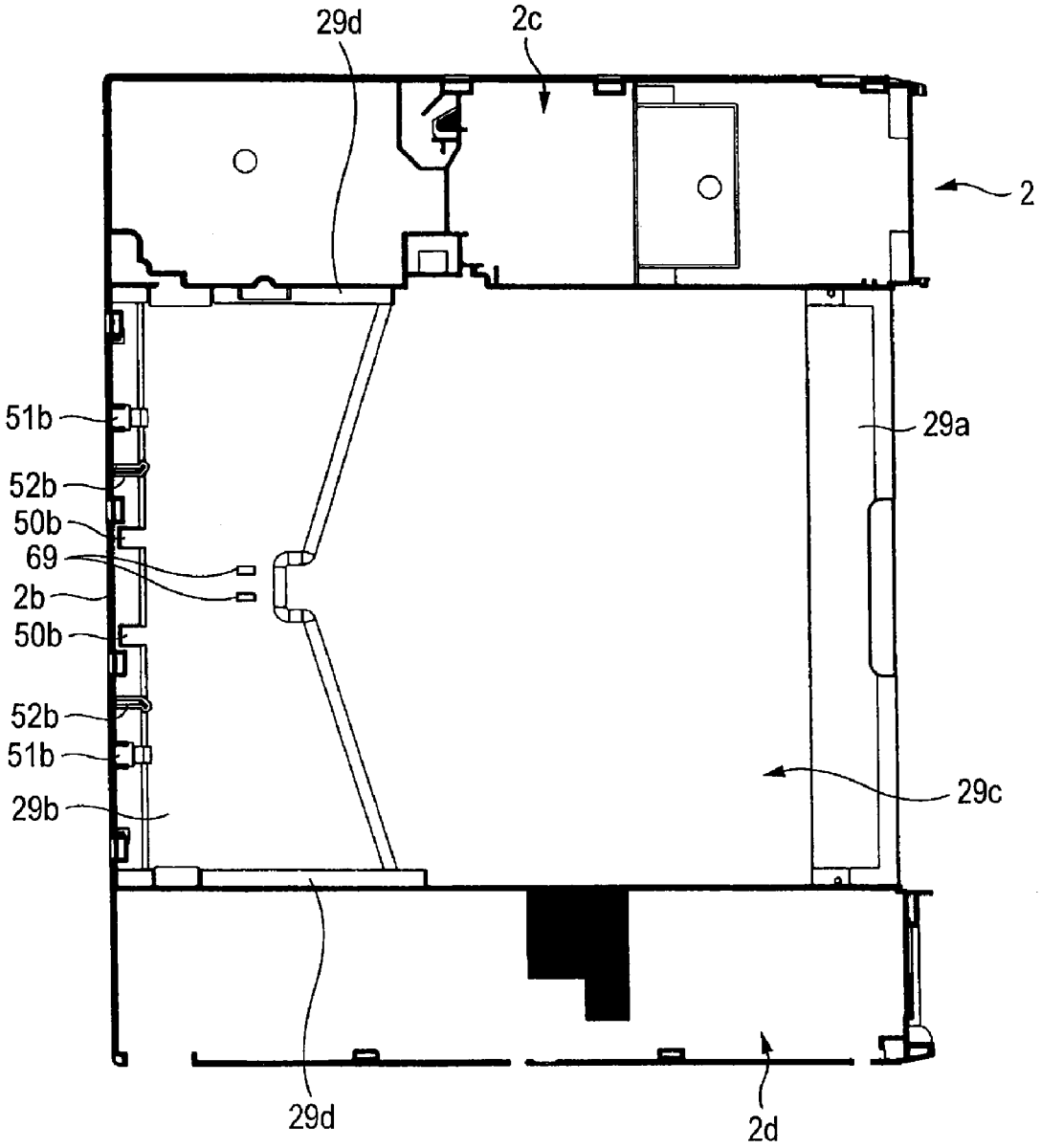
FIG. 6 is a sectional plan view of a lower side of the apparatus casing.
Figure 7:
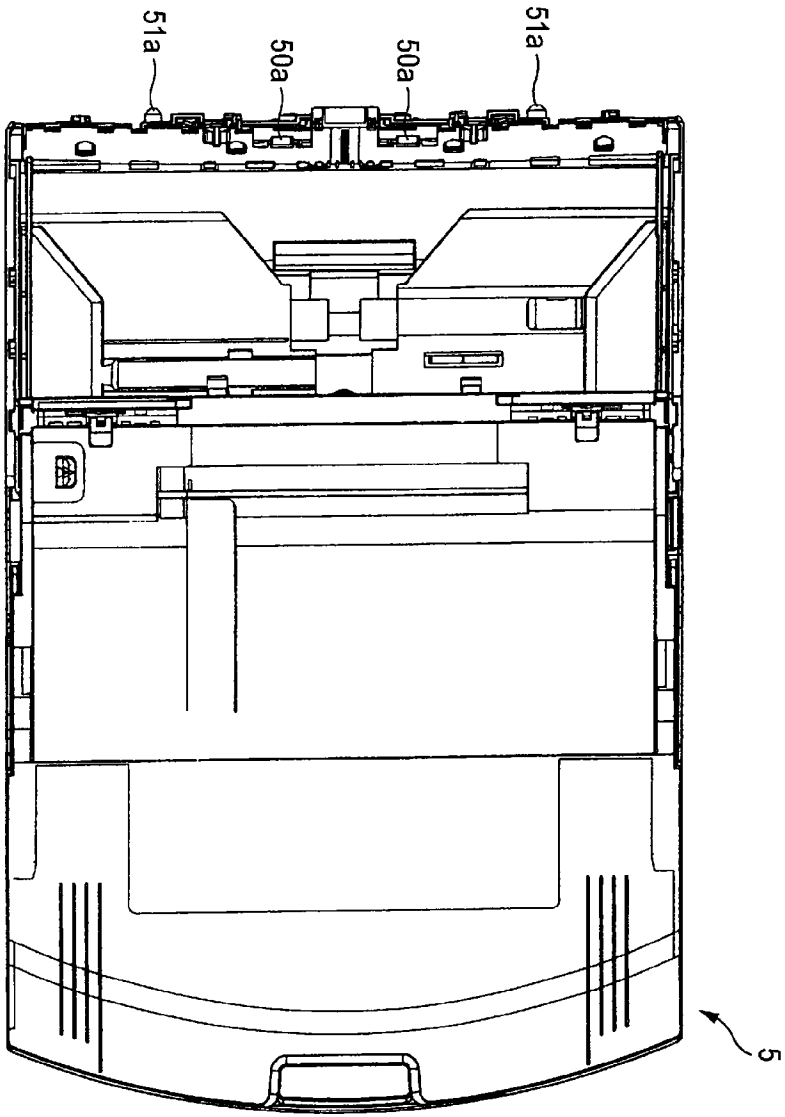
FIG. 7 is a plan view of a paper feeding cassette.
Figure 8:
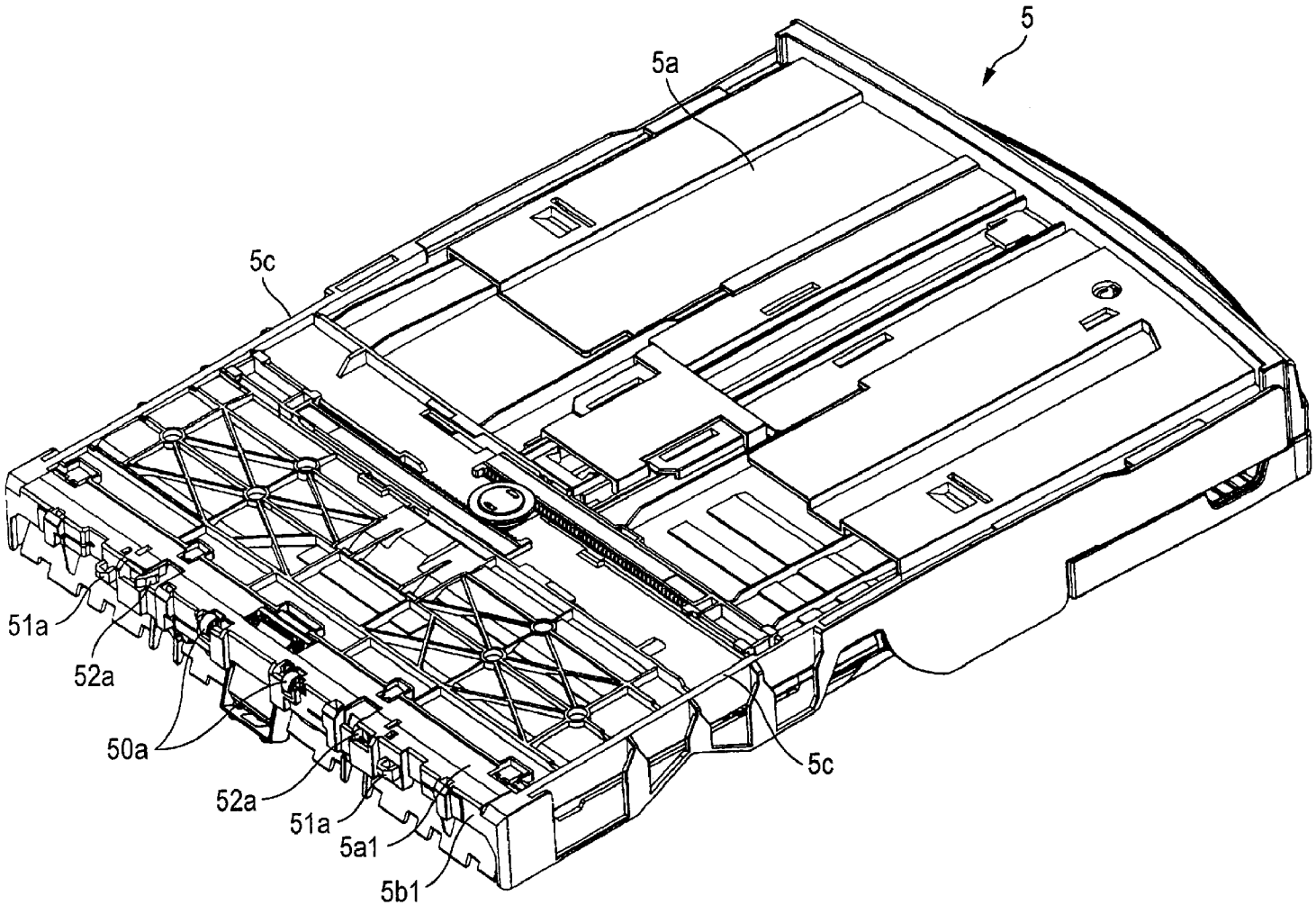
FIG. 8 is a lower surface perspective view of the paper feeding cassette.

On the inner side of the cassette housing 2*f* of the apparatus casing 2 facing the rear end side of the paper feeding cassette 5, escape grooves 50*b* in which a pair of rotary rollers 50*a* provided close to the center of the width direction (X axis direction) of the paper feeding cassette 5 without interference with each other, positioning portions 51*b* in which positioning engagement projections 51*a* of the paper feeding cassette 5 fit to maintain a state that the paper feeding cassette 5 is housed in the cassette housing 2*f*, and engagement hooks 52*b* for clicking portions 52*a* which enable recognition of completion of housing of the paper feeding cassette 5, are provided (see FIG. 6, FIG. 7, and FIG. 8).

At portions close to the center of the width direction (X axis direction) of the paper feeding cassette 5, a pair of rotary rollers 50*a* are provided on a corner where a rear bottom plate 5*a*1 and a rear end vertical plate 5*b*1 of the paper feeding cassette 5 intersect with each other. The height from the lower ends of the rotary rollers 50*a* to the lower surface of the rear bottom plate 5*a*1 is set to 1 to 2 millimeters, and the lower ends of the rotary rollers 50*a* slightly project downward from the lower surface of the rear bottom plate 5*a*1 (see FIG. 8).

On the left and right sides across the pair of rotary rollers 50*a* on the same corner, clicking portions 52*a* corresponding to the pair of left and right engagement hooks 52*b* are provided (see FIG. 7 and FIG. 8).

Next, the structure of the feed roller unit 6 as a paper feeding unit will be described in detail with reference to FIG. 3, FIG. 5, and FIG. 9 through FIG. 14. The feed roller unit 6 is provided with the arm body 44 as an integrally-molded item made of a synthetic resin, the drive shaft 14, the feed rollers 7, the transmission mechanism 45 assembled to the arm body 44, and so on. A torque from the drive shaft 14 is transmitted to the feed rollers 7 via the transmission mechanism 45. The transmission mechanism 45 includes a plurality of transmission gears.

Gears attachable to and detachable from the frame-shaped arm body 44 are the plurality of intermediate gears 47 (individually, as indicated by the reference numerals 47*a*, 47*b*, 47*c*, and 47*d*) in this aspect. Each of the intermediate gears 47 integrally molded from a synthetic resin material such as polyamide resin includes a main body having teeth formed on its outer peripheral surface, large-diameter bosses projectedly formed on the left and right end faces of the main body, and a shaft 48 formed so as to project to both sides along the rotation center line of the boss (see FIG. 11).

On the base end side of the arm body 44, a shaft hole 54 for pivotally supporting the drive shaft 14 rotatably is perforated. On the tip end side (free end side) of the arm body 44, a rotary shaft 55*a* integrally provided with a follower gear 55 is rotatably pivotally supported in the shaft hole, and a pair of feed rollers 7 are attached to both ends of the rotary shaft 55*a* (see FIG. 9, FIG. 10, and FIG. 11).

In the middle of the longitudinal direction of the arm body 44, an open gear box 44*a* which can pivotally support the intermediate gears 47*a*, 47*b*, 47*c*, and 47*d* in an engaged state is provided, and in this gear box 44*a*, a pair of bearings 60 for pivotally supporting the shafts 48 of each intermediate gear 47 are integrally molded so as to oppose each other. The first intermediate gear 47*a* in the transmission mechanism 45 always engages with the drive gear 14*a* that rotates integrally with the drive shaft 14, and power is transmitted to the follower gear 55 of the feed rollers 7 via the second intermediate gear 47*b*, the third intermediate gear 47*c*, and the fourth intermediate gear 47*d* in order.

Each bearing 60 is in a shape of a pillar, and on its tip end side, a shaft support groove 61 for supporting at least a part of the circumferential surface of each shaft 48 is provided. This shaft support groove 61 includes a U-shaped section, and includes an open portion which makes the intermediate gear 47 attachable and detachable toward the tip end direction of each bearing 60 in the direction orthogonal to the rotation axis line (see FIG. 10 and FIG. 11). Therefore, the pair of open portions 62 of the pair of bearings 60 is also opened to the sides opposing each other. Between the pair of bearings 60, the intermediate gears 47 are pushed together with the shafts 48 thereof to the bottom of the shaft support grooves 61 from the open portions 62 in a direction substantially orthogonal to the rotation axis line, whereby the shafts 48 can be pivotally supported in the shaft support grooves 61. Restriction pieces (not shown) for preventing detachment of the shafts 48 in the direction orthogonal to the rotation axis line are integrally provided adjacent to the shaft support grooves 61 and the open portions.

As described above, each intermediate gear 47 is provided with a shaft 48 projecting to both sides along the rotation axis line. A pair of bearings 60 for pivotally supporting the shafts 48 of the intermediate gears 47 are integrally formed on the arm body 44 so as to oppose each other, so that the pair of shafts 48 are pivotally supported like a center impeller by the pair of bearings 60 facing each other, so that the diameters of the shafts 48 can be made small and the frictional resistance in the shaft support groove 61 is small, so that the drive efficiency of the transmission mechanism 45 is not lowered.

The feed roller unit 6 is attached rotatably around the drive shaft 14 to the main body of the engine frame 39. The arm body 44 is always urged toward the downward turning direction by an urging unit such as a torsion spring 63 (see FIG. 14). When feeding sheets P from the paper feeding cassette 5 by separating these sheets P one by one, the LF motor 42 rotates in reverse and the drive shaft 14 rotates forwardly via the maintenance unit 36. The arm body 44 is always urged in the downward turning direction by an urging force of the urging unit, so that the feed rollers 7 at the tip end of the arm body 44 are pressed against the uppermost surface of the sheets P stacked in the paper feeding cassette 5 and the feed rollers 7 are rotated in the feed direction (counterclockwise in FIG. 3) via the transmission mechanism 45 provided on the arm body 44.

The stacked and accommodated sheets P are butted against a separating inclined plate 5*b* for separating sheets disposed at the tip end (right side end in FIG. 3) of the paper feeding cassette 5 by rotating the pair of feed rollers 7. Only the uppermost sheets P is separated by an elastic separating pad (formed of a leaf spring in this aspect) as a separating unit provided at the central portion in the width direction of the sheets P on the separating inclined plate 5*b* and fed to the recording unit via the U-turn conveying path 9.

When the sheet P is not separated and fed from the paper feeding cassette 5, the LF motor 42 rotates forwardly and the drive shaft 14 rotates in reverse, and the arm body 44 rises against the urging force of the urging unit of the torsion spring 63 or the like.

Next, description will be made to the configuration of the spacing actuating unit for actuating the arm body 44 by raising it according to the open portion 65 of a vertical through hole or a concave portion or the like opened upward formed in the bottom 5*a* of the paper feeding cassette 5 so as to prevent the feed rollers 7 from coming into contact with the surface of the bottom 5*a* of the paper feeding cassette 5 when stacked and accommodated sheet P have run out (are absent) in the paper feeding cassette 5. Base pads 64 also made of a high-frictional coefficient material (such as cork) are fixed (affixed) to portions of the bottom 5*a* of the paper feeding cassette 5 facing the outer peripheral surfaces of the pair of left and right feed rollers 7 as feed rollers also made of a material with a high frictional coefficient such as rubber (see FIG. 12).

Figure 11:
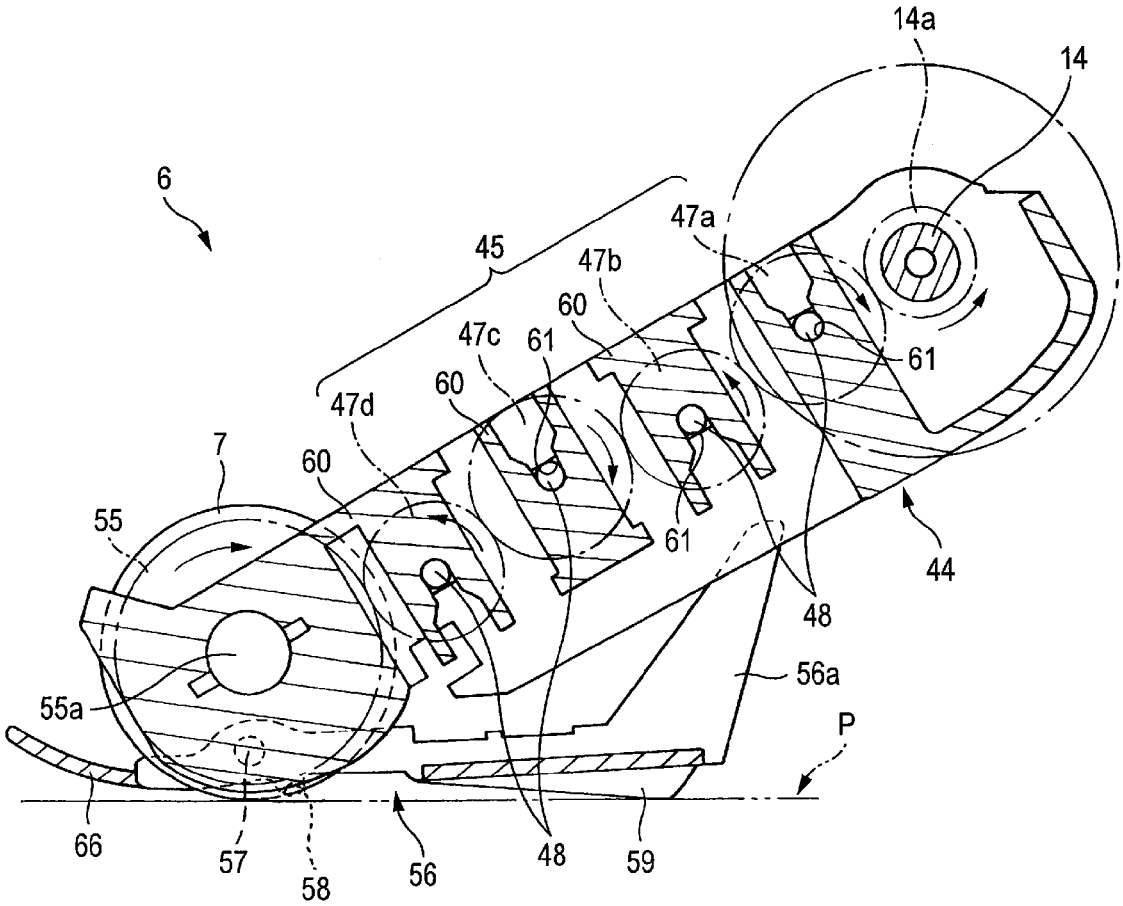
FIG. 11 is a sectional view on the arrow XI-XI of FIG. 10.
Figure 12:
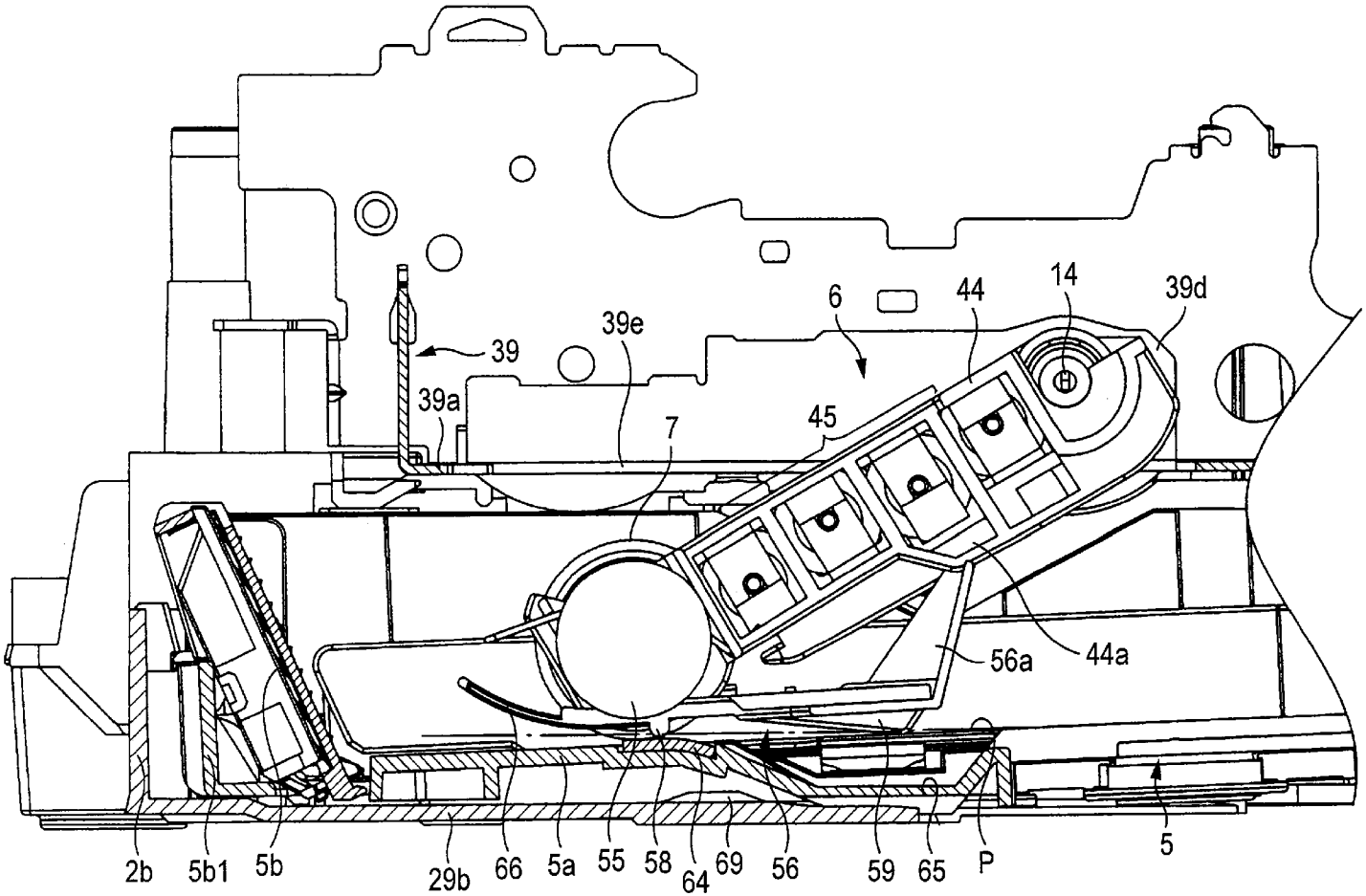
FIG. 12 is a main portion enlarged side sectional view showing a state that the number of sheets P stacked on the paper feeding cassette is one.
Figure 13:
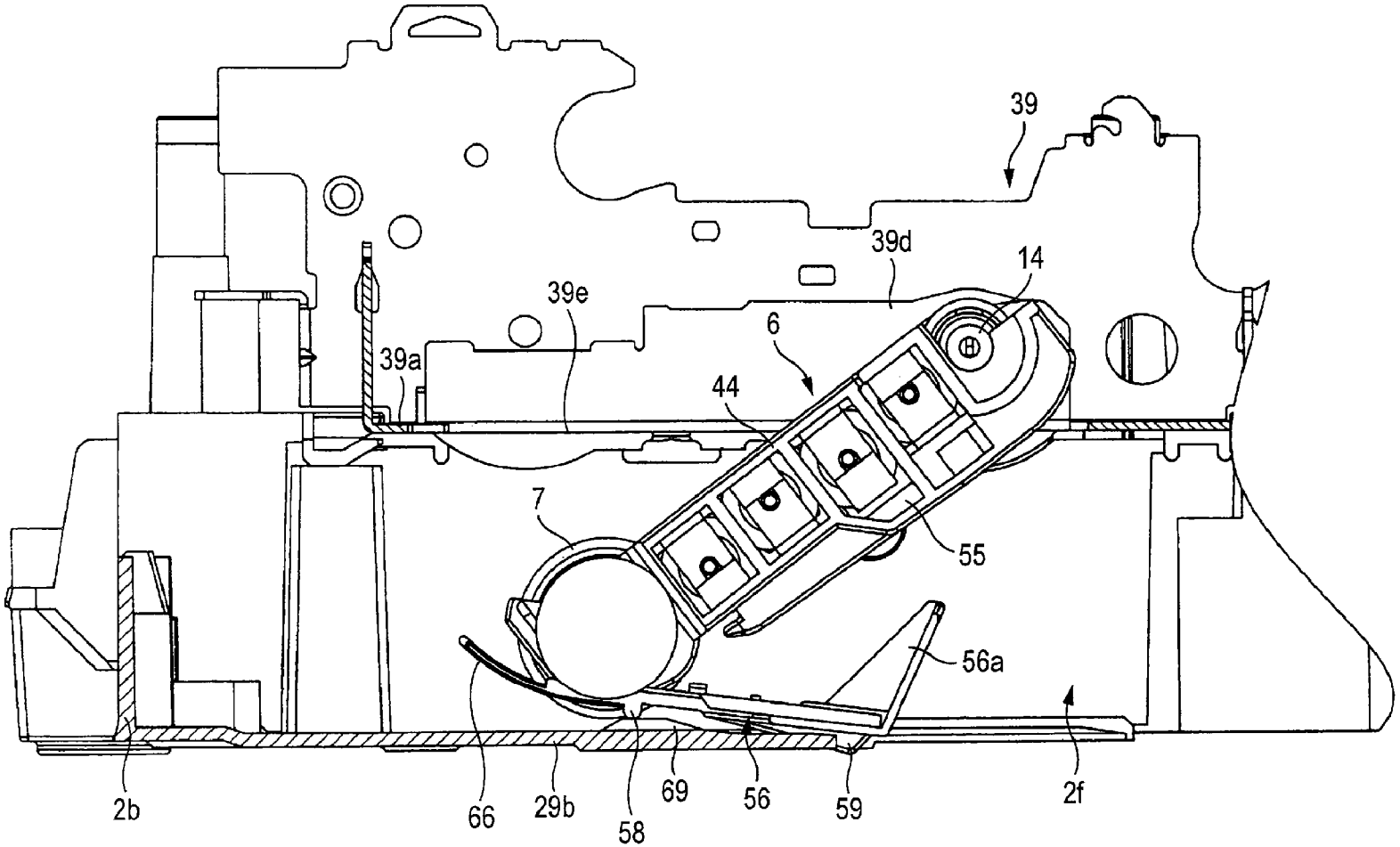
FIG. 13 is a main portion enlarged side sectional view showing a feed roller spaced from the surface of a bottom flat plate of the apparatus casing in a state that the paper feeding cassette is pulled out.

In the aspect shown in FIG. 9 through FIG. 14, a withdrawing unit is provided for preventing collision (interference) of the actuator 56 as the spacing actuating unit and the feed roller unit 6 (arm body 44 and feed rollers 7) with the tip end (inclined separating plate 5*b*) of the paper feeding cassette 5 when the paper feeding cassette 5 is substantially horizontally inserted into or extracted from the main body 2. In the bottom flat plate 39*a* of the main body of the engine frame 39, an opening 39*e* in which the arm body 44 fits only when the arm body turns upward is formed (see FIG. 12 and FIG. 13), and the drive shaft 14 extending in a direction orthogonal to the conveying direction of the sheets P is pivotally supported on a pair of support brackets 39*d* (only one is shown in FIG. 12 and FIG. 13) formed on the upper surface of the bottom plate 39*a* in a manner enabling the drive shaft to turn.

The actuator 56 is formed into a V shape in a side view, and the base end of the actuator 56 is attached to the shaft portions 57 provided on both side surfaces of the arm body 44 in a manner enabling the actuator to turn vertically (see FIG. 11). The upstream side portion in the feed direction of the actuator 56 and the forked upward ends 56*a* are formed to have heavy weights. On the lower surface on the upstream of the feed direction of the actuator 56, a detecting unit 59 is formed. Between the detecting unit 59 and the shaft portion 57, an actuating unit 58 projecting to the lower surface is formed (see FIG. 9, FIG. 12, and FIG. 13).

The detecting unit 59 fits in the open portion 65 opened in an aperture hole shape in the bottom 5*a* when the sheets P are absent. The actuating unit 58 has a function for spacing the feed rollers 7 from the bottom surface 5*a* by coming into contact with the bottom surface 5*a* of the paper feeding cassette 5. That is, when the detecting unit 59 fits in the open portion 65 and lowers, the actuating unit 58 becomes a fulcrum of the actuator 56 and pushes up the arm body 44. Furthermore, at the downstream side end in the feed direction of the actuator 56, a stopper piece 66 which comes into contact with the lower surface of the bottom plate 39*a* when the arm body turns up and most of the arm body fits into the opening 39*e* is integrally formed (see FIG. 9 through FIG. 13).

Therefore, as shown in FIG. 11, in a state when a plurality of sheets P are stacked in the paper feeding cassette 5, the feed rollers 7 come into contact with (are pressed against) the uppermost surface of the stacked and accommodated paper P. The actuator 56 can freely turn with respect to the arm body 44, so that the detecting unit 59 of the actuator 56 also comes into contact with the uppermost surface of the sheet P, however, the actuating unit 58 does not come into contact with the uppermost surface of the sheets P and an appropriate gap is left therebetween. When a paper feeding instruction is issued in this state, the drive shaft 14 rotates in a predetermined direction, and the feed rollers 7 rotate clockwise in FIG. 11 via the gear transmission mechanism 45 to butt the stacked and accommodated sheets P against the separating inclined plate 5*b* for separating paper disposed at the tip end (left side end in FIG. 12) of the paper feeding cassette 5. By the elastic separating pad (formed of a leaf spring in this aspect) as a separating unit provided at the central portion in the width direction of the sheets P on the separating inclined plate 5*b*, only the uppermost sheet P is separated and fed to the recording unit via the U-turn conveying path 9. This state is maintained until the last one sheet P remains on the bottom 5*a* as shown in FIG. 12.

When the last one sheet P is fed by the feed rollers 7 and the open portion 65 of the bottom 5*a* (the open portion 65 is a concave portion in the aspect of FIG. 3 and FIG. 12) appears, that is, the sheets P in the paper feeding cassette 5 have run out, the detecting unit 59 fits in the open portion 65, and when the actuating unit 58 in the middle of the actuator 56 comes into contact with the upper surface of the bottom 5*a*, due to the weights of the upstream side portion in the feed direction of the actuator 56 and/or the detecting unit 59, the arm body 44 is raised by the actuator 56 so as to space the feed rollers 7 by a slight distance from the bottom 5*a* (see FIG. 13). Thereby, even when the feed rollers 7 are driven to rotate in the feed direction, no frictional force occurs with the bottom 5*a*, so that excessive wearing of the outer peripheral surfaces of the feed rollers 7 can be prevented, as well as the stopping of the rotation of the feed rollers 7 by the base pads 64 (see FIG. 11) made of the high-frictional coefficient material (such as cork) provided on the upper surface of the bottom 5*a*, that is, a locked state can be avoided, and overload and burning of the LF motor 42 can be prevented.

As described above, the weight of the upstream side portion in the feed direction of the actuator 56 and/or the detecting unit 59 is increased to a degree enabling the actuator 56 to push up the arm body 44 when the sheets P have run out on the bottom 5*a* and the detecting unit 59 fits in the open portion 65. For increasing the weight, the actuator 56 may be made from a metal or a synthetic resin. The detecting unit 58 may be made of a metal material and may be provided with an urging unit such as a torsion spring for urging the detecting unit 58 side of the actuator 56 downward. Furthermore, a weight and the urging unit may be combined and used as appropriate.

Figure 9:
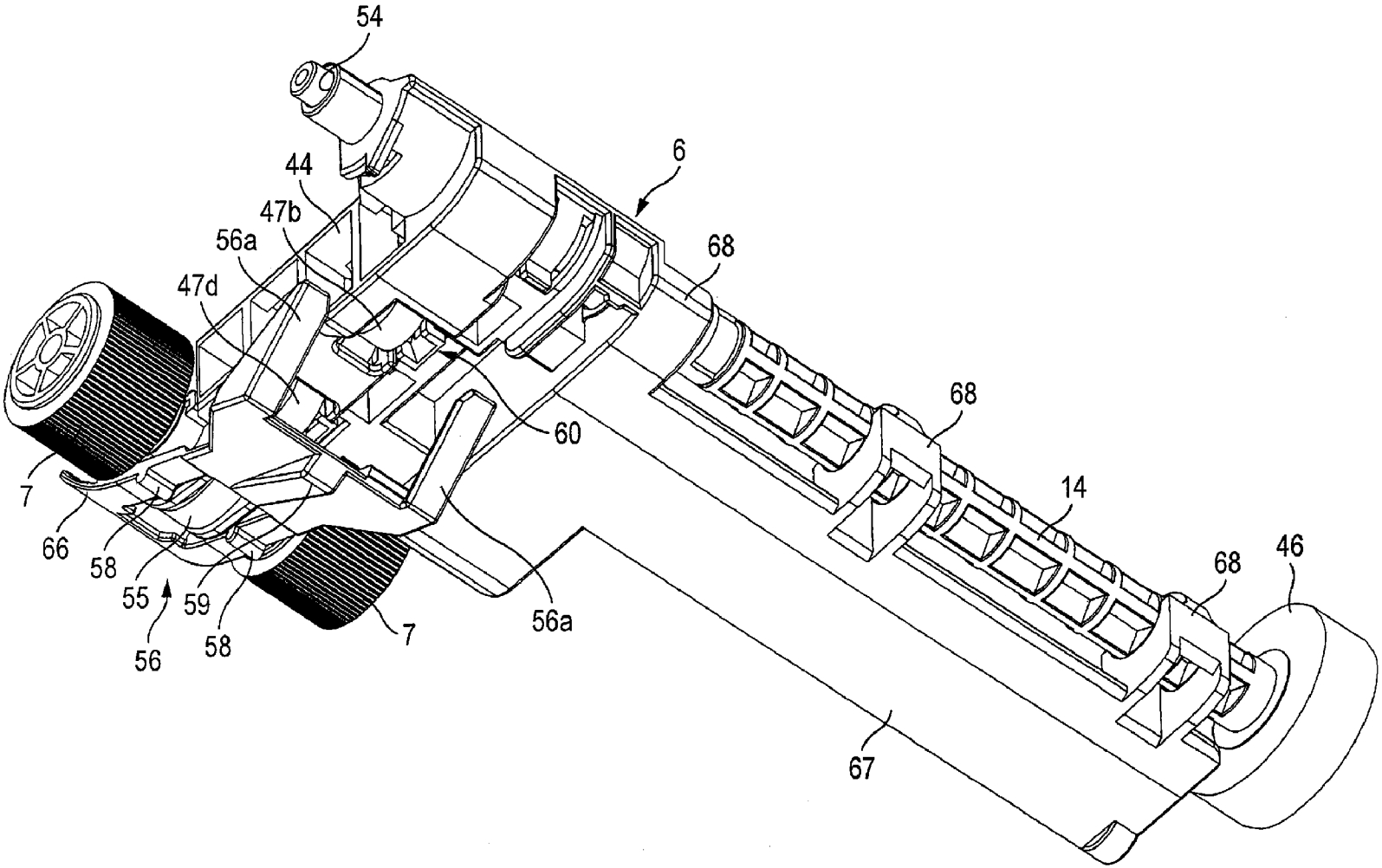
FIG. 9 is a perspective view of a feed roller unit and a spacing actuating unit viewed from the lower surface side.
Figure 10:
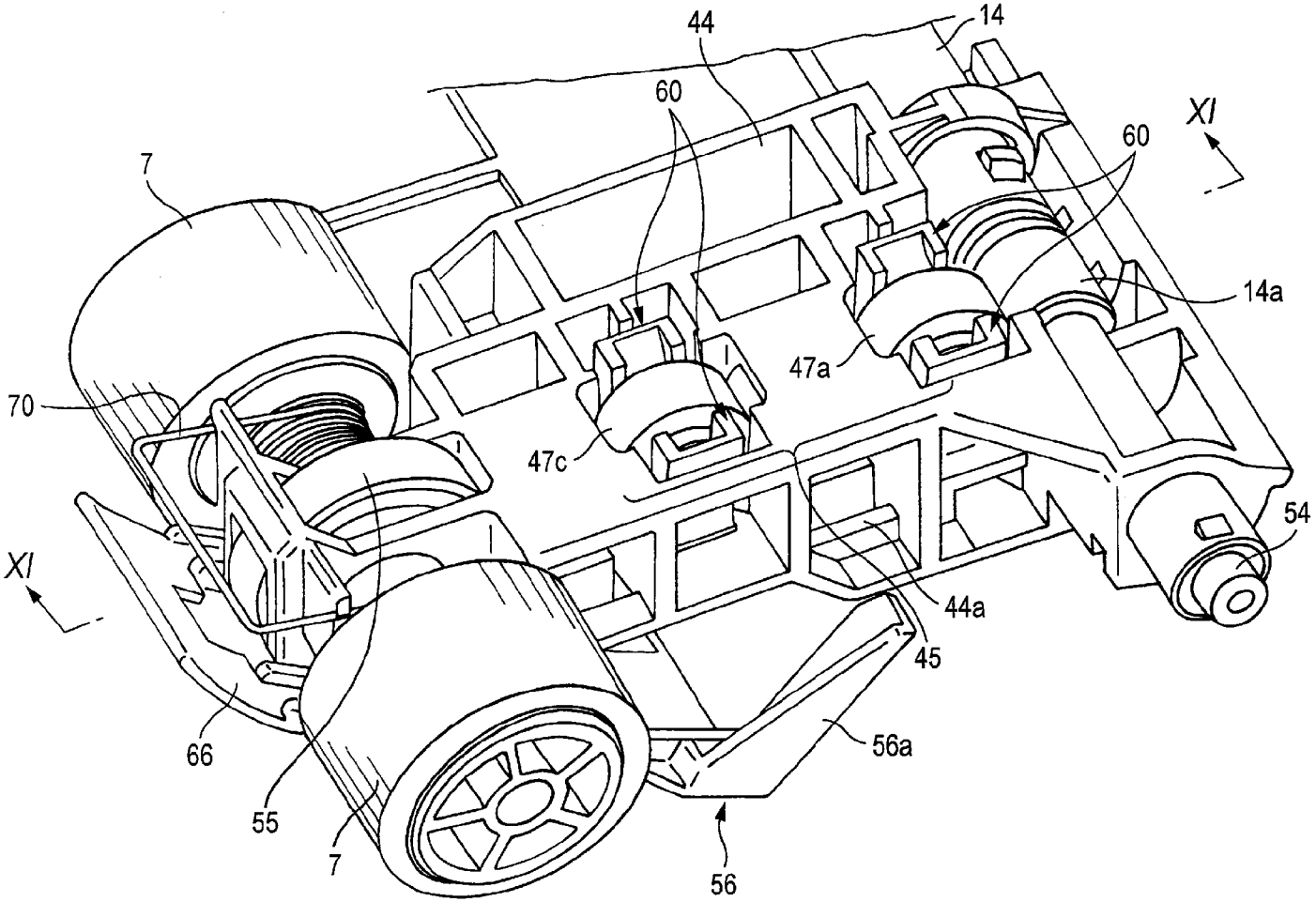
FIG. 10 is a partially cut-away perspective view of the feed roller unit and the spacing actuating unit viewed from the upper surface side.

Furthermore, on the arm body 44, awing 67 as a cam follower extending parallel to the axis line of the drive shaft 14 is integrally provided, and is supported rotatably with respect to the drive shaft 14 via a plurality of rings 68 provided on this wing 67 (see FIG. 9).

On the other hand, on the upper surface of one side plate (corresponding to the extending side of the wing 67) of the paper feeding cassette 5, a cam unit (not shown) whose height changes along the inserting and extracting direction of the paper feeding cassette 5 is formed (see FIG. 11). In this cam unit, the wing 67 as the cam follower, and the stopper piece 66 provided at the tip end of the actuator 56 form the withdrawing unit.

Next, the configuration of the restricting unit for avoiding contact of the feed rollers 7 with the bottom plate (second support 29*b* in this aspect) of the apparatus casing 2 when the paper feeding cassette 5 is pulled out of the apparatus casing 2 will be described.

Figure 14:
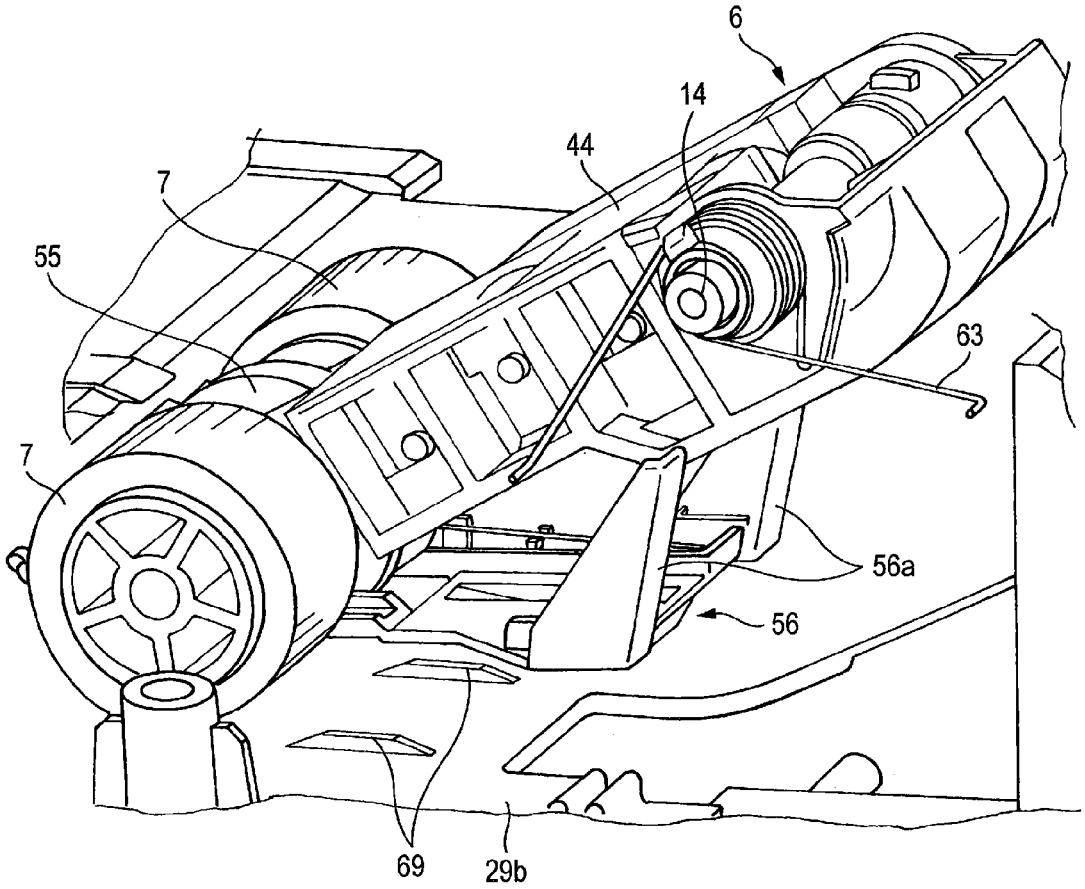
FIG. 14 is a partially cut-away main portion enlarged perspective view of the same.
Figure 15:
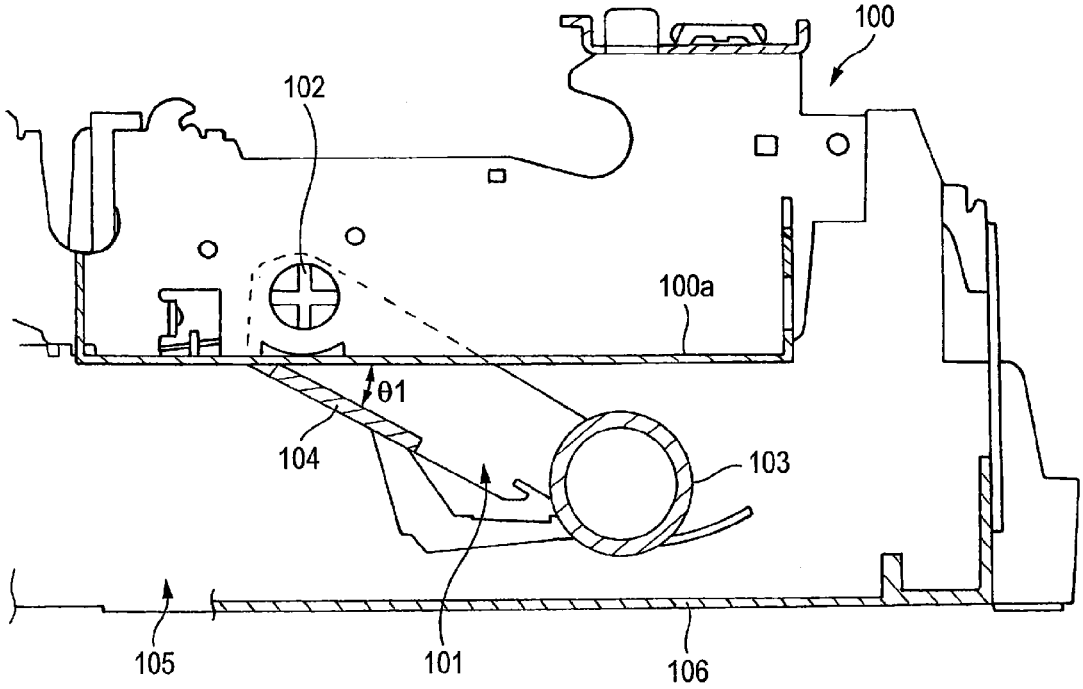
FIG. 15 is a side sectional view showing the conventional technique in which a feed roller is spaced from a bottom plate.

In the first aspect in which the actuator 56 that can turn up and down as a spacing actuating unit is provided on the arm body 44, projections 69 as the restricting unit for avoiding contact of the feed rollers 7 with the second support 29*b* by being contacted by the actuator 56 when the paper feeding cassette 5 is pulled out of the apparatus casing 2 are formed so that a pair of projections 69 long in the inserting and extracting direction of the paper feeding cassette 5 integrally project upward on the second support 29*b* as shown in FIG. 12 through FIG. 14.

In detail, when the paper feeding cassette 5 is pulled out of the cassette housing 2*f*, the downward-urged arm body 44 turns further downward, and the feed rollers 7 at the lower end of the arm body 44 are positioned lower than the height of the bottom 5*a* of the paper feeding cassette 5, and at this time, the actuating unit 58 projecting downward on the actuator 56 comes into contact with the projections 69 first, whereby the further downward turning of the arm body 44 is blocked, and the feed rollers 7 are prevented from coming into contact with the surface of the second support 29*b* (see FIG. 13). Thereby, dust and paper powder accumulating on the surface of the second support 29*b* are prevented from adhering to the lower surfaces of the feed rollers 1, and the feed rollers 7 are prevented from being unexpectedly contaminated. Furthermore, this is realized by a simple configuration in which the projections 69 are only provided on a part of the surface of the second support 29*b*, so that this does not increase the manufacturing cost and does not require an increase in height of the entire image recording apparatus.

Between the arm body 44 and the actuator 56, by providing a torsion spring 70 (see FIG. 10) which increases the contained angle between the arm body 44 and the actuator 56 (contained angle between the arm body 44 and the upstream side in the conveying direction of the actuator 56) in a direction of spacing the feed rollers 7 from the bottom 5*a* when the detecting unit 59 fits in the open portion 65, an effect of further reliably securing the pushing-up action for the lower end side of the arm body 44 is obtained.

In a second aspect of the restricting unit for avoiding contact of the feed rollers 7 with the bottom plate (second support 29*b* in this aspect) of the apparatus casing 2 when the paper feeding cassette 5 is pulled out of the apparatus casing 2, the above-described actuator 56 is not present on the arm body 44, and in this case, projections or convex portions (not shown) projecting upward on the surface of the second support 29*b* come into contact first with a part of the lower surface of the lower end of the arm body 44 that moved down to prevent (avoid) contact of the lower surfaces of the feed rollers 7 with other surfaces of the second support 29*b*.

Contrary to the description above, the restricting unit is a flat surface of the second support 29*b* and with this surface, a part of the lower surface of the arm body 44 that turns downward comes into contact. At this time, it is also allowed that the lower surfaces of the feed rollers 7 are prevented from coming into contact (made noncontact) with the second support 29*b* by providing a concave portion (escape concave portion) or a through hole (escape hole) provided at portions of the second support 29*b* with which the lower surfaces of the feed rollers 7 may come into contact.

In any configuration, only by a height relationship between the projections 69 or convex portions on the second support 29*b* and a part of the lower surfaces of the actuator 56 or the arm body 44, the arm body 44 can be made noncontact with the plane surface of the second support 29*b*, so that it is not necessary to consider the manufacturing tolerance of the arm body 44 and the attaching tolerance to the engine frame 39, and therefore, it is not necessary to increase the height of the entire image recording apparatus. In addition, dust and paper powder do not adhere to the feed rollers 7 in a state that the paper feeding cassette 5 is pulled out of the apparatus casing 2, so that the recorded media (sheet P) are prevented from being contaminated and the quality of recorded images is prevented from being deteriorated.

The present invention is not limited to the aspects described above according to the drawings, and can be variously changed and carried out without departing from the scope of the invention. For example, the feed rollers may be a pair of left and right feed rollers 7 or a feed roller 7 provided only on one side. The outer peripheral surface of the feed roller 7 may be made of a material with a high frictional coefficient such as rubber, or a base pad also made of a high-frictional coefficient material (such as cork) may be fixed (affixed) to a portion of the bottom 5*a* of the paper feeding cassette 5 facing the outer peripheral surface of each feed roller 7.

What is claimed is:

1. An image recording apparatus comprising:

a recording unit which records on sheet-like recorded media;

a cassette housing which houses a paper feeding cassette which accommodates the recorded media in a stacked manner so that the cassette can be inserted into and extracted from the cassette housing substantially in a horizontal direction, the cassette housing provided at a lower end of an apparatus casing;

a bottom plate which supports at least a part of a lower surface of the cassette, the bottom plate provided on a lower surface of the cassette housing;

an arm body which turns upward and downward according to a stacking amount of the recorded media in the cassette, the arm body arranged inside the apparatus casing;

feed rollers which rotate while pressing an uppermost surface of the recorded media, the feed rollers arranged at a tip end of the arm body; and a restricting unit which avoids contact of the feed rollers with the bottom plate when the cassette is pulled out of the apparatus casing, the restricting unit provided on the bottom plate in the apparatus casing.

2. The image recording apparatus according to claim 1, wherein the restricting unit is a convex portion which comes into contact with a part of a lower surface of the arm body turning downward to avoid contact of the feed rollers with the bottom plate.

3. The image recording apparatus according to claim 1, wherein the restricting unit is a concave portion or hole which makes the feed rollers noncontact with the bottom plate when a part of a lower surface of the arm body turning downward comes into contact with the bottom plate.

4. An image recording apparatus according to claim 1, further comprising a spacing actuating unit provided on the arm body, the spacing actuating unit fitting in an open portion formed in a bottom of the cassette and moves the arm body in a direction in which the feed rollers are spaced from the bottom of the cassette when the recorded media are absent, wherein when the paper feeding cassette is pulled out of the apparatus casing, the spacing actuating unit contacts the restricting unit so that the restricting unit avoids contact of the feed rollers with the bottom plate.

5. The image recording apparatus according to claim 4, wherein the spacing actuating unit includes:

an actuator which is attached to the arm body so that a base end portion of the actuator turns upward and downward, the actuator extending to a further upstream side of a feed direction than the feed rollers;

a detecting unit which is provided on a lower surface on the upstream side in the feed direction of the actuator and is in contact with the uppermost surface of the recorded media, the detecting unit fitting in an open portion formed in the bottom of the cassette when the recorded media are absent;

an actuating unit which is provided on the actuator on a further downstream side of the feed direction than the detecting unit and comes into contact with the bottom of the cassette to space the feed rollers from the bottom of the cassette; and an urging unit which urges the feed rollers in a direction of spacing from the bottom so as to increase a contained angle between the arm body and the actuator when the detecting unit fits in the open portion.

6. The image recording apparatus according to claim 1, wherein the arm body includes a transmission mechanism including a plurality of transmission gears which transmit power from a drive shaft positioned at a base end side of the arm body to the feed rollers.

* * * * *